US006093044A

United States Patent [19]

Arbuckle

[11] Patent Number: 6,093,044

[45] Date of Patent: Jul. 25, 2000

[54] QUICK CONNECT/DISCONNECT MECHANISM

[75] Inventor: James F. Arbuckle, Fresno, Calif.

[73] Assignee: Pelco, Clovis, Calif.

[21] Appl. No.: 09/061,691

[22] Filed: Apr. 16, 1998

[51] Int. Cl.[7] ..... H01R 13/627

[52] U.S. Cl. ..... 439/354

[58] Field of Search ..... 439/354, 350, 439/357, 353; 361/600

[56] References Cited

U.S. PATENT DOCUMENTS

| | | | |
|---|---|---|---|
| 4,165,944 | 8/1979 | Sunasky | 403/254 |
| 4,428,605 | 1/1984 | Follows | 292/152 |
| 4,547,016 | 10/1985 | Gabrielian | 297/194 |
| 4,792,165 | 12/1988 | Nishimura | 292/19 |
| 4,909,551 | 3/1990 | Buchanan | 292/175 |
| 5,219,191 | 6/1993 | Wolter | 292/157 |
| 5,257,839 | 11/1993 | Nielsen | 292/113 |
| 5,389,006 | 2/1995 | Noschese | 439/354 |
| 5,853,205 | 12/1998 | Enomoto et al. | 292/87 |

*Primary Examiner*—Neil Abrams
*Assistant Examiner*—Eugene G. Byrd
*Attorney, Agent, or Firm*—Prince, Yeates & Geldzahler

[57] ABSTRACT

A latching mechanism for latching the base of a surveillance camera and pan and tilt mechanism within the interior of an electrical receptacle box or housing comprises two components: a latch and a catch. The latch is the dynamic element of the latch mechanism, and is attached to or otherwise formed with the base which supports the pan and tilt mechanism and surveillance camera. The catch forms a part of the receptacle box or housing, and is the static element of the mechanism. The latch mechanism includes a dedicated latch that "latches" onto a dedicated catch of the catch mechanism in the base. The dedicated latch is spring-biased in the direction away from the center of the base and toward the catch mechanism, and also includes a downwardly depending release tab portion that is used for manually releasing the dedicated latch from the dedicated catch by enabling manual biasing of the dedicated latch in the direction toward the center of the base and away from the dedicated catch. It is preferable that two latch and catch mechanisms be used, diametrically opposed from one another on opposite sides of the base and housing. The dedicated latch and base each include barbed surfaces having slight reverse inclines that cause the dedicated latches to positively engage the respective dedicated catches, under the force of the weight of the base, camera and pan and tilt mechanism, when the base is positively latched within the housing. The electrical receptacle box or housing and the base each include mating electrical connectors that are oriented to self-align and fully interconnect simultaneously with the alignment and mechanical connection of the two latches and catches.

4 Claims, 5 Drawing Sheets

QUICK CONNECT/DISCONNECT MECHANISM

BACKGROUND OF THE INVENTION

1. Field of the Invention.

The present invention relates to a mechanical quick connect/disconnect latch mechanism, and more particularly relates to such a mechanism for connecting a base-mounted electric or electronic apparatus within a housing.

2. Description of the Prior Art.

Quick connect/disconnect latching mechanisms have many applications. Simple latches are used on doors and drawers. Slightly more complicated latching mechanisms are utilized in locking members for doors and drawers, as shown in U.S. Pat. No. 4,428,605, wherein a latching mechanism catches on the edge of a door or window to hold a locking mechanism in place, and is released by pressure applied to a pivot pin that pivots the latch away from the door or window edge so that the locking mechanism can be released.

Other latching mechanisms include an over-center latch mechanism, as in U.S. Pat. No. 5,257,839, wherein the over-center mechanism forms both the latch mechanism and the locking mechanism for same.

More complicated latching mechanisms are used for push-push latching and unlatching of doors, etc., as shown in U.S. Pat. No. 4,792,165, wherein a double hook-type latching mechanism latches or hooks onto a pedestal or base with a first push, a second push causing the latch hooks to be opened and the base expelled from therebetween in order to release the latch mechanism. Other latch assemblies, as in U.S. Pat. No. 5,219,191 utilize camming mechanisms to shift or slide latches or receptacles around catches in order to latch two pieces together. Spring/resilience forces hold the two pieces in latched condition until these forces are manually overcome to release the latch from the catch.

In the field of closed circuit television (CCTV), CCTV cameras and pan and tilt mechanisms have heretofore been mounted in housings (called "back boxes") generally by the use of threaded fasteners or other twist- or rotate-type fasteners which require the use of pliers, screwdriver or other specialty tool for the installation/removal of the camera and mounting into/from the back box. In addition, installing cameras and pan and tilt mechanisms into back boxes has been a three-step process.

The first step is to make the electrical connection between the camera/pan and tilt mechanism and the back box. This usually involves a fixed connector in either the back box or pan and tilt mechanism, with the mating connector being on the end of a section of wiring cable sufficiently long to permit the installer to manually access the back box interior and back (top) side of the pan and tilt mechanism in order to manually make the electrical connection.

The second step is to insert the pan and tilt mechanism up into the back box, while simultaneously maneuvering the excess electrical cable up and out of the way and into the back box behind (above) the pan and tilt mechanism, so that the pan and tilt mechanism can then be pushed up into the back box.

The third step is to use a mounting tool (generally a screw driver) to twist or rotate the screws or fasteners to mechanically secure the pan and tilt mechanism in the back box. This is all very awkward and cumbersome for a single installer; therefore, frequently two installers are needed for each single installation.

Alternatively, some pan and tilt mechanism designs are first pushed up into the back box and manually held in place for the second step, that of using the mounting tool to twist or rotate the screws or fasteners to mechanically secure the pan and tilt mechanism in the back box.

Thirdly, the installer makes the electrical connection between the camera/pan and tilt mechanism base and the back box housing by connecting the cable free end connector (on either the housing or the base) to the stationary connector (on the base or housing), thereafter maneuvering the excess electrical cable up and out of the way of the pan and tilt mechanism, so that the pan and tilt mechanism can freely rotate within the back box housing. Installing this type of pan and tilt, also, frequently requires two installers for each installation.

OBJECTS OF THE INVENTION

It is an object of the present invention to provide a quick, easy, and mechanically sound latch and catch quick connect/disconnect mechanism for mechanically mounting an electric or electronic device within a receptacle box or housing.

It is another objection of the invention to provide a quick connect/disconnect mechanism for an electric/electronic device, wherein the electrical connection and mechanical connection are effected simultaneously as the device is inserted into the receptacle box or housing, and without the use of tools.

It is a further object of the present invention to provide a mechanical quick connect/disconnect latching assembly that automatically catches upon insertion of the electronic device into the housing.

It is a further object of the present invention to provide a mechanical quick connect/disconnect latching mechanism that is easily releasable by the application of mechanical force on the latching mechanism from within the receptacle box or housing.

It is a further object of the present invention to provide a quick connect/disconnect mechanism for an electric/electronic device that mounts within a housing and is easily removed from the housing without the use of tools.

SUMMARY OF THE INVENTION

A latching mechanism for latching the base of a surveillance camera and pan and tilt mechanism within the interior of an electrical receptacle box or housing comprises two components: a latch and a catch. The latch is the dynamic element of the latch mechanism, and is attached to or otherwise formed with the base which supports the pan and tilt mechanism and surveillance camera. The catch forms a part of the receptacle box or housing, and is the static element of the mechanism. The latch mechanism includes a dedicated latch that "latches" onto a dedicated catch of the catch mechanism in the base. The dedicated latch is biased in the direction away from the center of the base and toward the catch mechanism, and also includes a downwardly depending release tab portion that is used for manually releasing the dedicated latch from the dedicated catch by enabling manual biasing of the dedicated latch in the direction toward the center of the base and away from the dedicated catch. It is preferable that two latch and catch mechanisms be used, diametrically opposed from one another on opposite sides of the base and housing.

The dedicated latch and dedicated catch each have inclined mating surfaces that engage each other as the base is inserted into the housing, causing the dedicated latch to shift and pivot slightly around and behind (above) the dedicated catch to retain the base in position within the housing. The dedicated latch and base also include barbed surfaces having slight reverse inclines that cause the dedicated latches to positively engage the respective dedicated catches, under the force of the weight of the base, camera and pan and tilt mechanism, when the base is positively latched within the housing.

The electrical receptacle box or housing and the base each include mating electrical connectors that are oriented to self-align and fully interconnect simultaneously with the alignment and mechanical connection of the two latches and catches. In this manner, the electrical connection is made simultaneously with the mechanical connection between the housing and base, without any secondary effort involved, as for instance, initially connecting the electrical connectors, followed by effecting the mechanical connection between the base and the housing, or alternatively, initially effecting the mechanical connection between the base and housing, and secondly, making the electrical connection between the housing and the base.

DETAILED DESCRIPTION OF THE INVENTION

Figure 1:
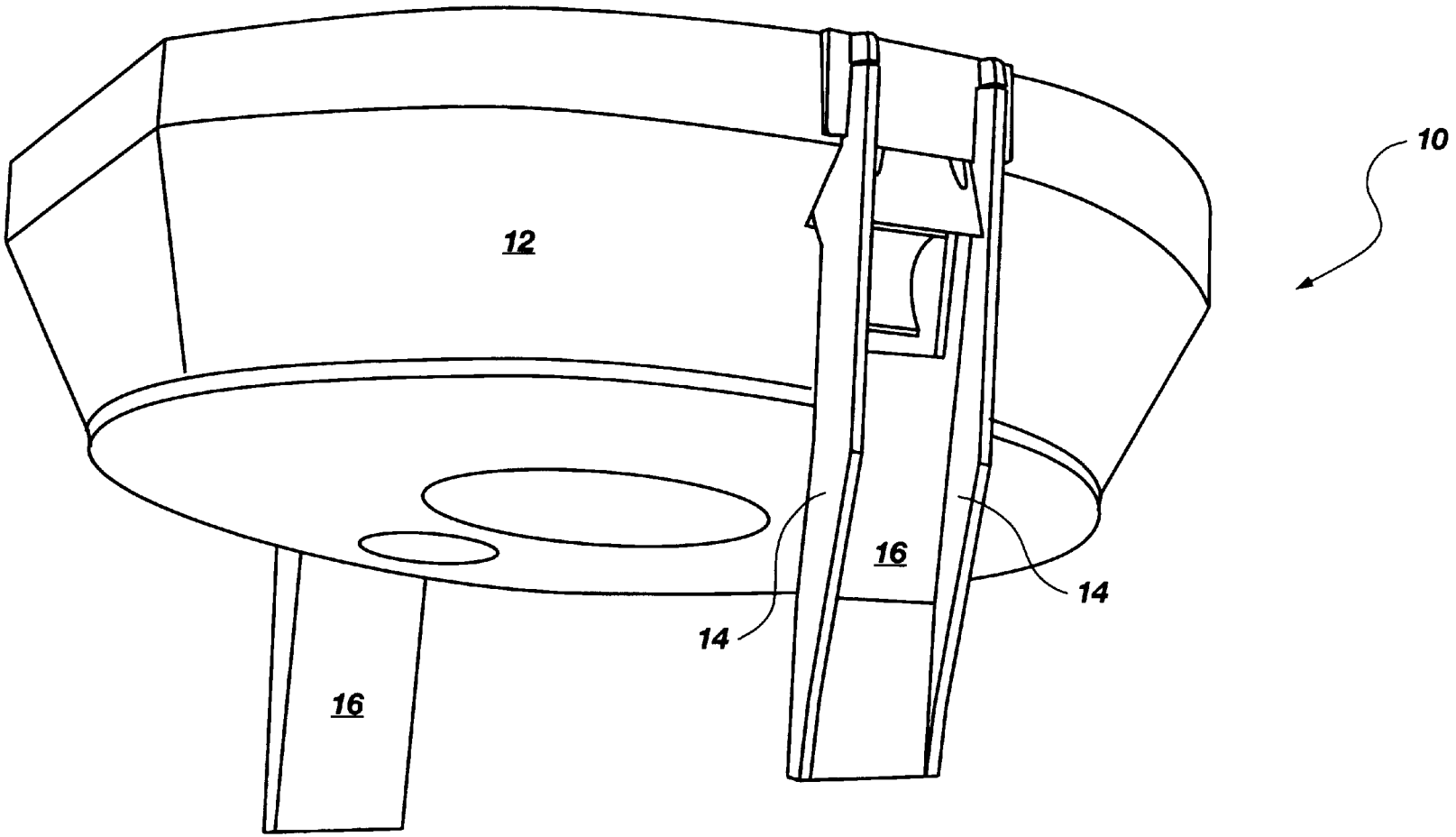
FIG. 1 is a pictorial view of the latch portion of the quick connect/disconnect mechanism of the present invention, shown as part of the mounting base for the electric/electronic device within the housing.

Turning now to the drawings, and initially to FIG. 1, the latch portion of the quick connect/disconnect mechanism of the present invention is shown generally illustrated by the numeral 10. The latch portion 10 is shown attached to or otherwise formed with a mounting structure (base) 12 of an electric/electronic device that is to be quick connect/disconnect mounted inside a housing or receptacle (not shown in FIG. 1). In the device illustrated, the base 12 is essentially a circular/cylindrical structure to which is attached a pan and tilt mechanism for a remote control video surveillance camera (not shown).

The latch portion 10 comprises a pair of essentially parallel frame members 14 connected by an intermediate transverse bridge member 16 to define a "U" or "C" shaped channel for structural integrity, not unlike a structural "C" channel. In the preferred embodiment, the base and latch portions are separate and are made of a plastic material having sufficient resiliency to enable the C channel of the latch portion to flex slightly under manual bias, inwardly toward the base for purposes of releasing the latch mechanism, as will be explained in further detail hereinbelow.

Figure 2:
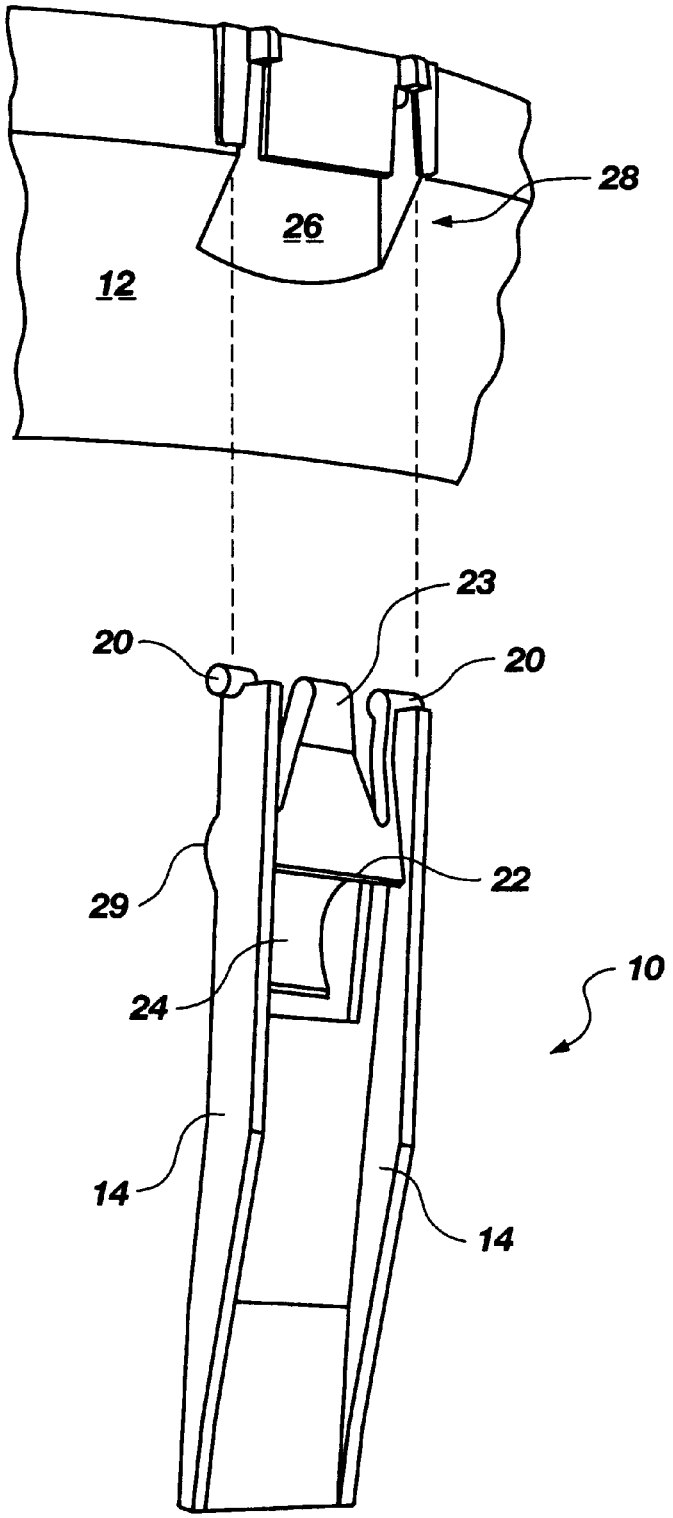
FIG. 2 is a pictorial view of the latch portion of the quick connect/disconnect mechanism similar to FIG. 1, showing the latch portion removed from the mounting base.

The latch portion of the quick connect/disconnect mechanism 10 is more clearly shown in FIG. 2. As will be explained in greater detail hereinbelow, the latch portion 10 is the dynamic element of the latch mechanism, and is adapted to pivot slightly relative to the base 12 about a pair of axially co-aligned bosses 20 formed at the respective upper ends of the parallel frame members 14. The latch portion 10 includes a dedicated latch 22 that is adapted to catch on a mating dedicated catch formed in the interior of the housing into which the base 12 is to be installed. This dedicated catch is illustrated more clearly in FIG. 4. The latch-catch construction and mechanism will be more clearly explained with reference to FIGS. 4–7.

As shown in the drawings, the dedicated latch 22 angles outwardly from the plane of the transverse bridge member 16 of the latch portion 10. In addition, the dedicated latch 22 is formed with an upward extending structural support 23 that serves to distribute the force and weight of the base 12 and its accompanying surveillance camera, pan and tilt mechanism, etc. As illustrated more clearly in FIGS. 3, 5, 6 and 7, the backside of the dedicated latch structural support 23 is rounded at the same radius as the two axially co-aligned bosses 20, and is in axial alignment therewith. In this manner, the force and weight of the base 12 and accompanying electronic components are more evenly distributed across the entire width of the latch portion 10, with specific force and weight support provided by the dedicated latch structural support 23. As can be appreciated, when the latch portion 10 is installed in the base 12, the upper portion of the structural support 23 and the co-aligned bosses 20 engage and support a mating concave surface formed in the upper portion of the base. This is shown more clearly in FIGS. 5–7.

Returning to FIG. 2, the dynamic latch portion 10 is adapted to pivot slightly about the two axially co-aligned bosses 20 within and relative to the base 12. It is intended, however, that the latch portion will be constantly biased outwardly from the base in order to ensure that the dedicated latch 22 is in constant and secure engagement with the mating catch (shown in FIG. 4). To this end, the latch portion 10 is formed with a bow spring 24 that is adapted to engage a flat surface 26 formed in the latch portion recess 28 of the base 12 in a manner to constantly bias the latch portion 10, and specifically the dedicated latch 22, outwardly from the base 12, thereby biasing the dedicated latch 22 into functional engagement with the dedicated catch in the housing (shown in FIG. 4) to retain the base 12 and its associated camera and electronic and mechanical components in functional position within the housing.

Figure 3:
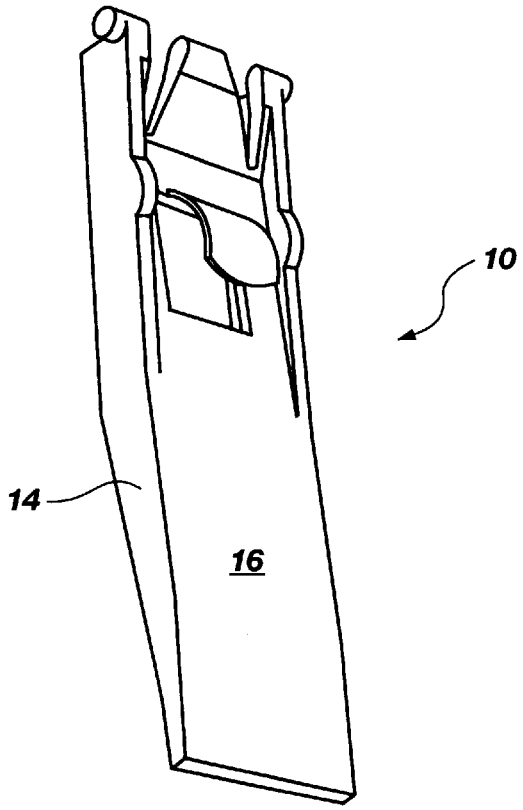
FIG. 3 is a pictorial view of the backside of the latch portion of the quick connect/disconnect mechanism shown in FIG. 2.

FIGS. 2 and 3 also illustrate a protuberance or bead 29 formed on the base side of the respective latch portion parallel frame members 14, the purpose of the bead being to limit the inward travel of the latch portion as it is manually biased inwardly toward the base 12 to release the base from the housing. As can be appreciated from FIG. 2, the bead 29 engages the flat surface 26 in the housing latch recess to limit the inward travel of the latch portion in order to prevent undue stress and potential failure of the bow spring 24 when removing the base 12 from the housing or enclosure.

Figure 4:
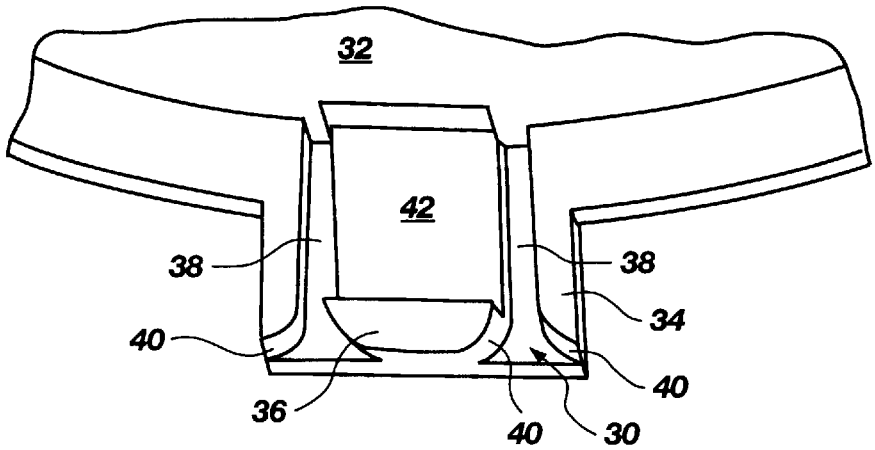
FIG. 4 is a pictorial view of the catch aspect of the quick connect/disconnect mechanism formed inside the housing.

FIG. 4 illustrates the catch portion 30 on the interior cylindrical surface of the housing 32. The catch portion is the static element of the latch mechanism and is formed as part of a downwardly depending boss 34. The catch portion includes a dedicated catch 36 for engaging the dedicated latch 22 (not shown in FIG. 4) for retaining the base and its associated surveillance camera and electrical and mechanical hardware within the housing. The boss 34 includes two essentially parallel channels 38 for receiving the respective parallel frame members or ribs 14 of the quick connect/disconnect latch portion. Each parallel channel 38 also includes at its opening, opposed rounded side surfaces 40 that define a funnel into the channel for directing and registering the respective latch portion ribs 14 into boss parallel channels 38.

Figure 5:
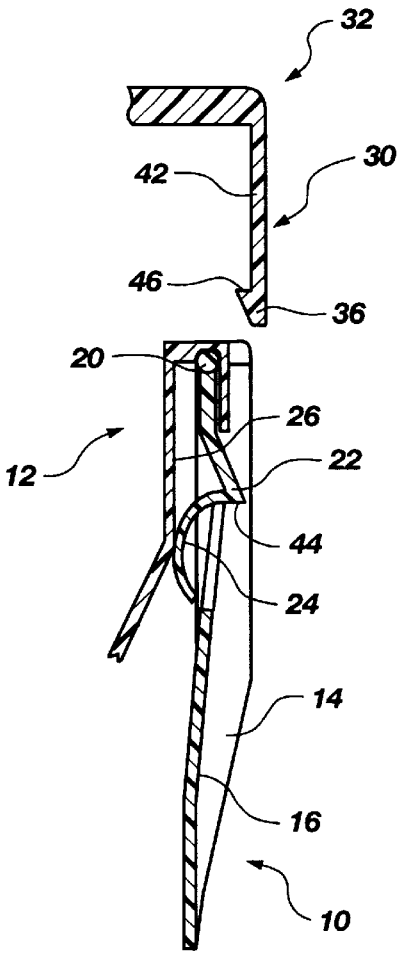
FIG. 5 is a vertical sectional view taken through the center of the latch mechanism and catch mechanism showing the latch prior to insertion into the catch mechanism of the housing.

As shown in FIGS. 4 and 5, the housing catch portion 30 includes a recessed surface 42 defining a pocket into which the dedicated latch 22 is received when the base is latched in functional position within the housing. The base latched in functional position in the housing is illustrated in FIG. 6.

Figure 6:
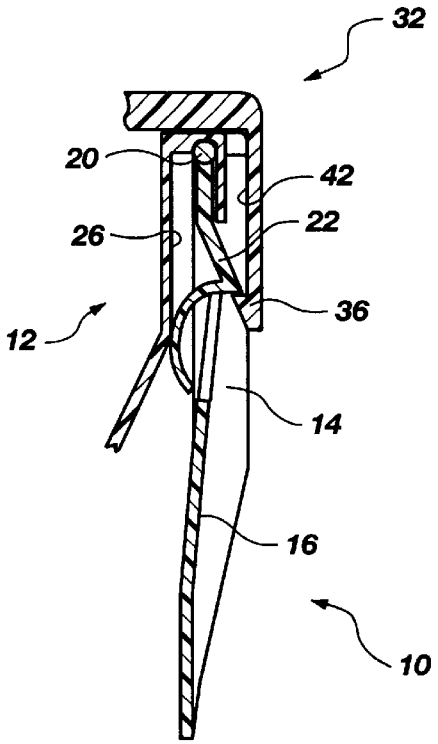
FIG. 6 is a partial sectional view similar to FIG. 5, showing the latch of the electric/electronic device mounting structure in "latched" position against the catch within the housing.
Figure 7:
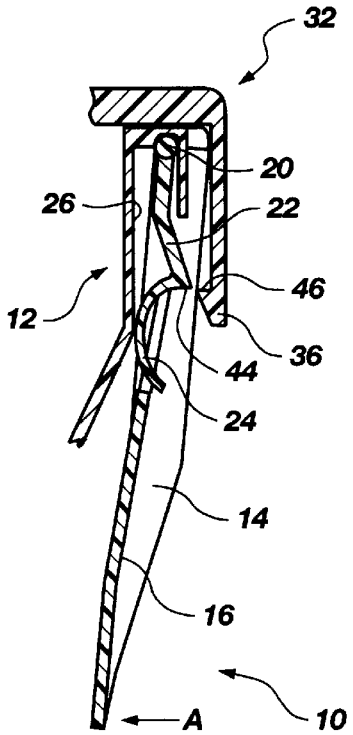
FIG. 7 is a partial sectional view similar to FIGS. 5 and 6, showing the electric/electronic device mounting assembly and latch mechanism inserted fully into the electric junction box/housing, but with the latch mechanism pulled away from and released from the catch, so that the electric/electronic device mounting structure may be withdrawn from the housing.

FIGS. 5, 6, and 7 also better illustrate the design particulars of the dedicated latch 22 and dedicated catch 36. Specifically, the dedicated latch and catch are formed with respective barbs 44 and 46 (best shown in FIG. 5) for ensuring a positive engagement between the catch and latch when the base is latched in functional position within the housing. As can be appreciated, the latch barb 44 is pointed downwardly and has a bottom surface (not numbered) that is inclined slightly upwardly from horizontal. Likewise, the catch barb 46 has an upward surface (not numbered) that is inclined slightly downwardly at essentially the same angle from horizontal as that of the latch barb lower surface. In this manner, these two mating surfaces (the downward facing inclined surface on the latch barb 44 and the upward facing inclined surface on the catch barb 46) define a slightly downwardly inclined ramp when the two surfaces engage, in a manner to bias the dedicated latch 22 outwardly toward the dedicated catch 36 into the securely latched position (to the right as shown in FIGS. 5–7), under the force of the weight of the base and its associated surveillance camera and components. This slightly downwardly inclined ramped surface ensures a positive connection and fit between the dedicated latch and dedicated catch, and also functions, in concert with the bow spring 24, to bias the latch portion 10 outwardly from the base and toward the housing catch portion 30 to maintain a positive connection between the dedicated latch and the dedicated catch. In this manner, the installer can immediately tell whether the latch portion is "latched" with the catch portion by observing the downward angle of the latch portion 10 when the base is supposedly "latched" within the housing. Specifically, the installer visually notes the parallelism or nonparallelism of the latch portion relative to the inside cylindrical surface of the housing (not shown), knowing that a parallelism between the latch portion and the housing interior surface indicates a fully "latched" relationship between the latch portion and the catch portion, and conversely, a non-parallelism between the latch portion and the housing interior cylindrical surface indicates an incomplete latched connection.

In addition, because of the facts that (1) the latch barb is inclined slightly downwardly because of the upwardly inclined bottom facing surface (not shown) and (2) the catch barb 46 projects slightly upwardly because of its slightly downwardly inclined upwardly facing surface (not numbered), when installing the base up into the housing, the bow spring 24, biasing the latch mechanism outwardly (to the right in FIGS. 5–7), causes the latch portion (and specifically the dedicated latch 22 and latch barb 44) to "snap" into position within the recess formed by and above the catch barb 46. This is shown in FIG. 6 wherein the latch portion 10 is fully inserted into the housing catch portion, with the dedicated latch 22 "latched" in functional position above the dedicated catch 36.

FIG. 7 illustrates the position and orientation of the latch portion 10 during manual removal of the base from the receptacle. Specifically, the latch portion 10 has been pushed inwardly in the direction of arrow A (to the left in FIG. 7) against the bias of the bow spring 24, in order to translate the dedicated latch 22 to the left from behind (above) the dedicated catch 36. As shown in FIG. 7, once the dedicated latch 22 is beyond the barb 46 of the dedicated catch, the base can be pulled straight downwardly and removed from the housing.

Figure 8:
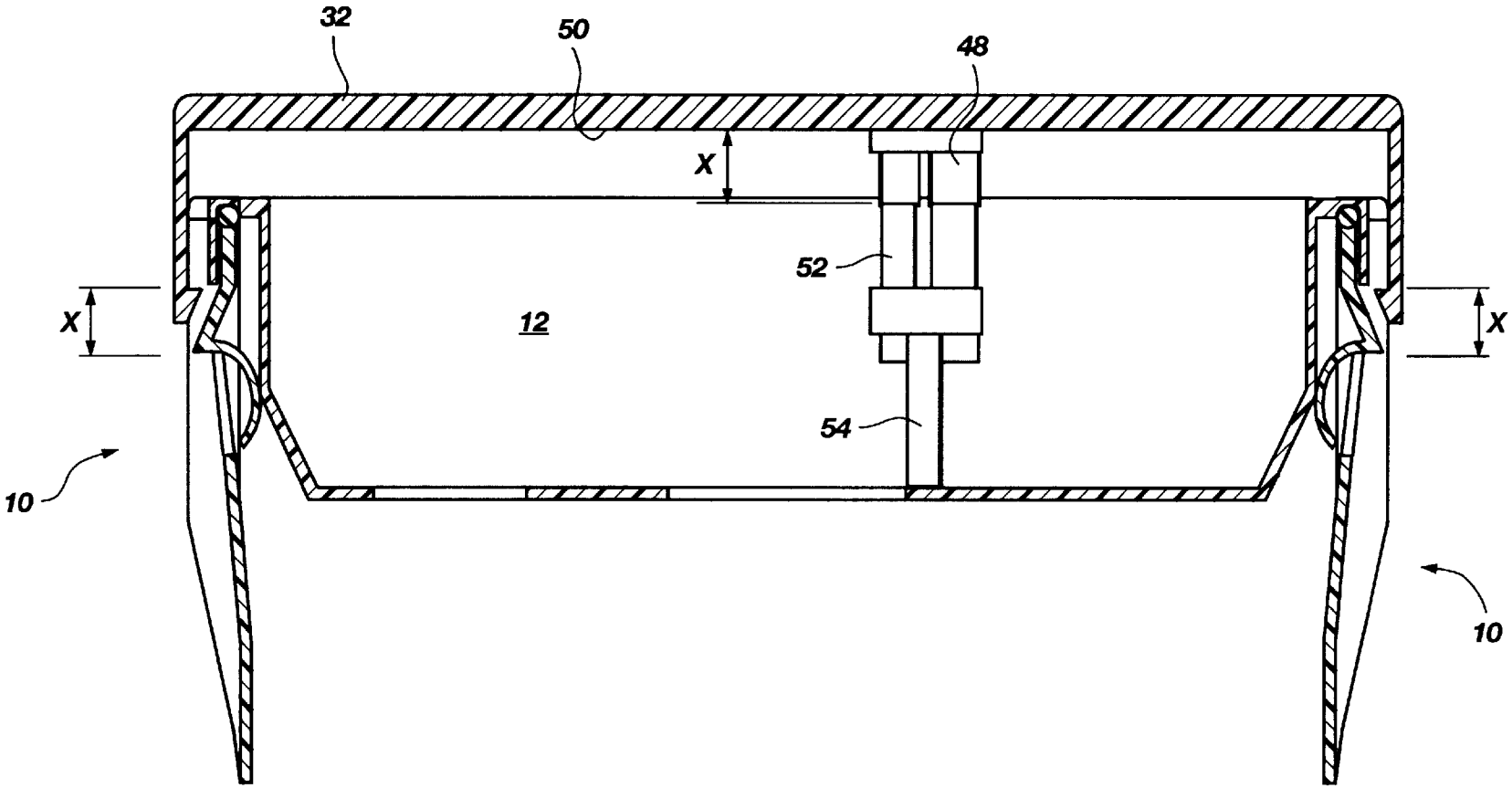
FIG. 8 is a vertical sectional view illustrating the mounting assembly as it is being inserted into the electric junction box/housing in order to simultaneously effect the electrical and mechanical connections between the junction box/housing and electric/electronic device mounting structure.

FIG. 8 is a vertical sectional view illustrating the mounting structure or base 12 as is being inserted up into the housing 32. As will be explained in greater detail hereinbelow, the housing is a distance X from being fully inserted into the back box wherein the two dedicated latches 22 catch on respective dedicated catches 36. FIG. 8 shows only the latching/catching portion of the housing 32, the portion of the housing 32 shown being fitted within a larger, usually metallic housing enclosure having vertically depending sides that essentially totally enclose the camera and pan and tilt mechanism therein (not shown in FIG. 8). In addition to illustrating the two latching mechanisms 10, which are explained with reference to FIG. 2, and the two mating receptacle housing catch portions 30 (shown in FIG. 4), the housing 32 also includes an electrical connector 48 permanently mounted to the upper inside surface 50 of the housing 32 in a customary manner. This housing electrical connector 48 mates with a mating base electrical connector 52 that is fixedly mounted on a boss 54 formed within a concavity of the base 12. As shown in FIG. 8, the mating connectors 48 and 52 are spaced the same distance X from their fully connected orientations as the base 12 is spaced the distance X from the housing 32. It will be appreciated, therefore, that the mating connectors are fully electrically connected when the base 12 is fully inserted up into the housing 32 such that the dedicated latches 22 latch behind (above) the respective dedicated catches 36 formed with the housing 32. In this manner, the electrical connection between the base 12 and the housing 32 is automatically and simultaneously made when the base is inserted (pushed) up into the back box housing, and the electrical connection is complete when both latches "snap" into place behind (above) the respective catches.

It also should be noted that the mating connectors 48 in the back box housing and 52 in the base 12 are oriented for automatic alignment when the base is indexed to/with the back box housing for simultaneous interconnection of the two mating electrical connectors and the two dedicated latches with their respective dedicated catches, without further secondary effort, as in sequentially making the electrical connection, stowing the excess electrical cable, making the mechanical connection, and finally using a screw driver or other tool to rotate the mechanical fastener to hold the camera and pan and tilt mechanism in position within the back box housing, as in prior art devices.

Operation

To install the base 12 within its receptacle or housing, the installer visually aligns the two latch portions 10 with their respective downwardly depending bosses 44 formed within the inner cylindrical surface of the housing, and then simply pushes the base up into the housing. The self-aligning cooperation between the latch portion ribs 14 and the parallel channels 38 formed in the boss, index the rotational orientation of the base with the housing so that the latch portion will catch on the housing catch portion when the base is fully inserted up into the housing. Likewise, the base electrical connector 52 aligns with the housing electrical connector 48 as the self-aligning cooperation between the latch portion ribs and parallel channels formed in the downwardly depending boss in the housing indexed the rotational orientation of the base with the housing. In this manner, when the base is rotationally oriented with the housing such that the dedicated latches 22 are aligned with the respective dedicated catches 36, the base electrical connector 52 is automatically indexed with the housing electrical connector 48.

As the installer inserts the base up into the housing, he is not necessarily required to manually bias the two latch portions inwardly toward the base. Rather, as shown in FIG. 5, as the base is inserted up into the housing and the latch portion travels upwardly into the catch portion mating inclined outward surfaces of the dedicated latch 22 and dedicated catch 36 cause the dedicated latch (and entire latch portion) to shift and pivot inwardly toward the base as the latch 22 passes around the dedicated catch 36. As can be appreciated, when the latch portion is fully inserted into the catch portion, the latch barb 44 will "snap" into position behind and above the catch barb 46, and occasionally strike the recessed surface 42 of the catch portion 30. Therefore, the installer need only listen for the two confirming "snaps" that confirm that the two latch portions are "latched" in functional position behind and above the respective catch portions. Upon hearing these two "snaps", the installer can be assured that the base is "latched" in functional position within the housing.

More importantly, however, the installer need not concern himself with the prior art sequence of connecting the two electrical connectors, stowing the excess electrical cable, inserting the base 12 with its accompanying pan and tilt mechanism and camera up into the back box housing 32, and lastly, employing a screw driver or other tool to rotate the fasteners to retain the base, camera and pan and tilt mechanism within the back box housing. The present invention eliminates all of these prior art steps except the step of simply inserting the base, camera and pan and tilt mechanism up into the back box housing, which action simultaneously aligns the base with the back box housing, aligns the two mating electrical connectors, aligns the two dedicated latches with their respective dedicated catches, and enables simultaneous electrical connection and mechanical connection of the base and its associated hardware with and into the back box housing, without any secondary efforts or steps necessary.

With the base latched within the housing, releasing the upward force on the base causes the weight of the base, camera, pan and tilt, etc. to be distributed directly to the two latch barbs 44, and specifically to the slightly downwardly inclined facing surfaces of the latch barbs. This downward force, in combination with the force of the bow springs 24, biases the latch barbs outwardly into positive engagement with respective dedicated catches 36, and specifically with respective catch barbs 46.

To remove the base and its associated surveillance camera and hardware, the installer grasps the base (more specifically, he grasps the surveillance camera and associated mounting hardware) in the palms of his hands while placing an index finger on the outer surface of the transverse bridge member 16 of each latch portion. Pressing inwardly on each latch portion will bias the respective dedicated latch and barb 22 and 44 inwardly toward the housing and away from its respective mating dedicated catch 36 and catch barb 46, as shown in FIG. 7. Because of the slight inclined ramp surfaces on the back side of each barb (on the downward facing side of the latch barb 44 and the upward facing side of the catch barb 46), it will be advantageous for the installer to push up slightly on the camera and base in order to more easily release the respective dedicated latches 22 from their respective dedicated catches 36.

With both latch portions pressed inwardly toward the base, as shown in FIG. 7, the dedicated latches 22 are released from the dedicated catches 36, and the installer may simply pull the surveillance camera and base downwardly and out from the housing. As the installer releases the dedicated latches 22 from the dedicated catches 36 and pulls the surveillance camera and base downwardly and out of the housing, he simultaneously therewith disengages the electrical connection between the base and the back box housing in a single simple action of pulling the base down out of the housing, again without any secondary effort, as in rotating the fasteners that hold the base in the housing, or manually reaching up behind (above) the base and into the housing to manually disconnect the two electrical connectors, as in prior art devices. Rather, as the electrical connection and mechanical connection between the base and back box housing are made simultaneously by the installer simply pushing the surveillance camera and base upwardly and into the housing, the electrical connection and mechanical connection are simultaneously disengaged by the installer simply pulling the surveillance camera and base downwardly and out from the housing.

From the foregoing it will be seen that this invention is one well adapted to attain all of the ends and objectives herein set forth, together with other advantages which are obvious and which are inherent to the composition and method. It will be understood that certain features and subcombinations are of utility and may be employed with reference to other features and subcombinations. This is contemplated by and is within the scope of the claims. As many possible embodiments may be made of the invention without departing from the scope of the claims. It is to be understood that all matter herein set forth or shown in the accompanying drawings is to be interpreted as illustrative and not in a limiting sense.

What is claimed is:

1. A quick connect/disconnect mechanism for removably mounting an electrical fixture to a housing, the quick connect/disconnect mechanism comprising:

a first member having a first electrical connector and a first mechanical connector separate from the first electrical connector; and a second member having a second electrical connector for engaging and mating with the first electrical connector, and a second mechanical connector, separate from the second electrical connector, for engaging and mating with the first mechanical connector, the second electrical connector and second mechanical connector being positioned and oriented on the second member so that the second electrical connector engages the first electrical connector contemporaneously as the second mechanical connector engages the first mechanical connector when the second member is attached to the first member to mount the electrical fixture to the housing.

2. A quick connect/disconnect mechanism as set forth in claim 1, wherein the first member has two first mechanical connectors and the second member has two second mechanical connectors, the second electrical connector and both second mechanical connectors being positioned and oriented on the second member so that the second electrical connector engages the first electrical connector contemporaneously as both second mechanical connectors engage respective first mechanical connectors when the second member is attached to the first member.

3. A quick connect/disconnect mechanism as set forth in claim 1, wherein the design of the first and second mechanical connectors is such that they automatically interconnect without the use of tools.

4. A quick connect/disconnect mechanism as set forth in claim 1, wherein the design of the first and second mechanical connectors is such that they are manually disconnectable without the use of tools.

* * * * *